US010682685B2

(12) United States Patent
Tami Lizuzu et al.

(10) Patent No.: US 10,682,685 B2
(45) Date of Patent: Jun. 16, 2020

(54) METHOD OF MAKING A MULTI-VANE MODEL, TOOLING, AND AN ASSEMBLY COMPRISING A MULTI-VANE MODEL AND A HOLDER ELEMENT

(71) Applicant: Safran Aircraft Engines, Paris (FR)

(72) Inventors: Joseph Toussaint Tami Lizuzu, Gonesse (FR); Thierry Eric Cogneras, Montmorency (FR); Pascal Francis Patrick Gomez, Lisses (FR); Hervé Bruno Marc Osmont, Saint Maur des Fosses (FR); Anthony Dominique Désiré Scattolini, Claye Souilly (FR)

(73) Assignee: Safran Aircraft Engines, Paris (FR)

( * ) Notice: Subject to any disclaimer, the term of this patent is extended or adjusted under 35 U.S.C. 154(b) by 0 days.

(21) Appl. No.: 16/246,055

(22) Filed: Jan. 11, 2019

(65) Prior Publication Data

US 2019/0217377 A1 Jul. 18, 2019

(30) Foreign Application Priority Data

Jan. 15, 2018 (FR) ..... 18 50283

(51) Int. Cl.

| | |
|---|---|
| ***B22C 7/02*** | (2006.01) |
| ***F01D 25/00*** | (2006.01) |
| ***B22C 9/04*** | (2006.01) |
| ***F01D 9/04*** | (2006.01) |

(52) U.S. Cl.

CPC ..... *B22C 7/02* (2013.01); *B22C 9/04* (2013.01); *F01D 9/047* (2013.01); *F01D 25/005* (2013.01); *F05D 2220/32* (2013.01); *F05D 2230/21* (2013.01)

(58) Field of Classification Search

CPC .. B22C 7/00; B22C 7/005; B22C 7/02; B22C 7/026; B22C 9/04

See application file for complete search history.

(56) References Cited

U.S. PATENT DOCUMENTS

| | | | |
|---|---|---|---|
| 3,848,654 | A | 11/1974 | Boyle et al. |
| 4,464,094 | A | 8/1984 | Gerken |
| 2014/0262115 | A1 | 9/2014 | Hanrahan et al. |

FOREIGN PATENT DOCUMENTS

| | | | |
|---|---|---|---|
| CN | 204182860 | U | 3/2015 |
| GB | 2053757 | A | 2/1981 |

OTHER PUBLICATIONS

INPI Search Report and Opinion for corresponding French patent application FR 1850283 dated Jul. 3, 2018 (2 pages).

*Primary Examiner* — Kevin P Kerns
*Assistant Examiner* — Steven S Ha
(74) *Attorney, Agent, or Firm* — Bookoff McAndrews, PLLC

(57) ABSTRACT

A method of making a multi-vane model for a nozzle guide out of sacrificial material, includes the steps of fabricating a single-vane model out of sacrificial material, assembling at least two sacrificial material single-vane models with each other, and positioning (104, 108) a holder element on at least one sacrificial material single-vane model so as to hold a predetermined spacing between an inner platform and an outer platform. An assembly of a sacrificial material single-vane model for a nozzle guide together with a holder element, and also an assembly of a sacrificial material multi-vane model for a nozzle guide together with a holder element.

8 Claims, 3 Drawing Sheets

METHOD OF MAKING A MULTI-VANE MODEL, TOOLING, AND AN ASSEMBLY COMPRISING A MULTI-VANE MODEL AND A HOLDER ELEMENT

CROSS-REFERENCE TO RELATED APPLICATION(S)

This application claims priority under 35 U.S.C. § 119 to French Patent Application No. 1850283, filed Jan. 15, 2018, the entirety of which is incorporated by reference herein.

TECHNICAL FIELD

The present disclosure relates to making models out of a material that may be eliminated in order to form a multi-vane nozzle guide.

TECHNOLOGICAL BACKGROUND

So-called "lost wax" or "investment" casting methods are particularly suitable for producing metal parts that are complex in shape. Thus, lost wax casting is used in particular for producing multi-vane nozzle guides for turbomachines.

In lost wax casting, the first step is to make a model out of a sacrificial material that may be eliminated at a melting temperature that is comparatively low, such as for example a wax or a resin, with the mold being made by being overmolded on the model. Once the mold has consolidated, the sacrificial material is discharged from the inside of the mold, which is referred to as a "shell" mold. Thereafter, molten metal is cast into the mold so as to fill the cavity left in the mold after the model has been discharged therefrom. Once the metal has cooled and has solidified completely, the mold may be opened or destroyed in order to recover a metal part having the shape of the model made of sacrificial material.

In order to be able to produce a plurality of parts simultaneously, it is possible to combine a plurality of models made of sacrificial material in a single cluster, with each sacrificial material model of being connected to at least one structure, generally a central shaft that is not made of sacrificial material and to a distribution ring that is made out of sacrificial material. Inside the mold, the ring forms casting channels for the molten metal, also referred to as the feed system.

In the present context, the term "metal" covers both pure metals and metal alloys.

Multi-vane nozzle guide sectors are commonly made by assembling together a plurality of single-vane models made of sacrificial material so as to build up a multi-vane model made of sacrificial material. Nevertheless, because of the shape that is desired for certain parts of the nozzle guide, it may be found difficult to keep the dimensions and the shape of the model made of sacrificial material after it leaves the injection mold, and this applies in particular for the platforms of the vanes of the nozzle guide whenever they present a size that is relatively large and a thickness that is relatively small, e.g. forming a relatively large overhang.

Specifically, at the outlet from the injection mold used for making the single-vane model, the single-vane models made of sacrificial material are at a temperature where irreversible and major deformation may occur to the shape of the single-vane model. This risk remains present until the single-vane model made of sacrificial material has stabilized at ambient temperature.

Furthermore, prior to assembly, each single-vane model is subjected to non-destructive inspection of the single-vane model in order to verify that the single-vane model complies with the manufacturing dimensions and tolerances. When a plurality of single-vane models are judged to comply with specifications, they may be assembled together with one another so as to build up a multi-vane model made of sacrificial material.

During these steps, the handling of the single-vane models and of the multi-vane models may also give rise to risks of the single-vane or multi-vane models being deformed, and in particular to risks of their platforms being deformed.

Such deformation may also occur during subsequent steps of handling multi-vane models made of sacrificial material, such as for example while forming the shell mold, e.g. while the multi-vane model made of sacrificial material is being dipped in a slurry.

Unfortunately, the dimensions and tolerances for multi-vane nozzle guides may not accommodate such unwanted deformation, so multi-vane models that are not in compliance may not be used for making a shell mold. Specifically, the use of non-compliant multi-vane models would lead to scrapping of the multi-vane nozzle guide sectors that are obtained as a result of casting metal into the shell mold that is obtained from such non-compliant multi-vane models, in particular when the platforms present unwanted deformation having a direct influence on the size of the fluid flow passage.

In the disclosure below, the terms "inner" and "outer" are defined relative to the central axis of the turbomachine in which the elements are to be assembled, with the term "inner" relating to an element that is closer to the central axis than an "outer" element, and the terms "upstream" and "downstream" are defined relative to the normal flow direction of the stream through the turbomachine.

SUMMARY

The present disclosure seeks to remedy those drawbacks, at least in part.

To this end, the present disclosure provides a method of making a sacrificial material multi-vane model for a nozzle guide, the method comprising the following steps:

fabricating a sacrificial material single-vane model, the sacrificial material single-vane model comprising a vane extending between an inner platform and an outer platform;

assembling at least two sacrificial material single-vane models in an assembly direction in order to form the sacrificial material multi-vane model that has at least two vanes, an inner platform, and an outer platform; and between a fabrication step for fabricating and an assembly step for assembling together and/or after the assembly step;

a positioning step for positioning a holder element on at least one sacrificial material single-vane model so as to hold predetermined spacing between the inner platform and the outer platform.

By means of the holder element, predetermined spacing is held between the inner platform and the outer platform, thereby enabling the sacrificial material single-vane model and/or the sacrificial material multi-vane model to be stiffened and reducing the risks of deformation while handling the single-vane and multi-vane models.

The term "fabricating" for the single-vane model is used to designate the step or the plurality of steps that serve to obtain a sacrificial material single-vane model that may be manipulated with limited risks of deforming the single-vane model. Thus, after the fabrication step, the temperature of the sacrificial material forming the single-vane model is about ambient temperature.

The predetermined spacing is defined between a point of the inner platform, in particular a point forming part of the outer surface of the inner platform, and a point of the outer platform, in particular a point forming part of an inner surface of the outer platform. These two points are preferably in alignment along an axis intersecting the central axis of the turbomachine. For example, the predetermined spacing may be defined between a point forming part of an outer surface of the inner platform and a point forming part of an inner surface of the outer platform at the upstream end of the single-vane model.

By way of example, the sacrificial material single-vane model may be fabricated by injection molding or by additive fabrication.

According to some embodiments, the assembly step may be performed by adhesively bonding at least two single-vane models together.

According to some embodiments, the adhesive bonding may be performed with the sacrificial material.

According to some embodiments, the step of fabricating the single-vane model out of sacrificial material comprises the following steps:

injecting the sacrificial material into a mold in order to make the single-vane model out of sacrificial material;

unmolding the sacrificial material single-vane model; and shaping the sacrificial material single-vane model after unmolding it.

It can be understood that the holder element is different from the shaping tooling. The shaping tooling serves to shape the sacrificial material single-vane model while the single-vane model is cooling and solidifying, whereas the holder element serves to reduce the risks of deforming the single-vane model and/or the multi-vane model while those single-vane and/or multi-vane models are being handled.

According to some embodiments, the positioning step is performed between the fabrication step and the assembly step, the holder element being positioned on the single-vane model.

It is thus possible to reduce the risk of deformation while handling the sacrificial material single-vane models, e.g. during non-destructive inspections performed on the single-vane models and/or during the step of assembling together single-vane models in order to form a multi-vane model.

According to some embodiments, the holder element includes an inner housing and an outer housing, the inner housing and the outer housing being spaced apart by a predetermined distance corresponding to a desired nominal dimension between a free end of the inner platform and a free end of the outer platform, the positioning step comprising positioning the free end of the inner platform in the inner housing and positioning the free end of the outer platform in the outer housing.

The inner housing is of a shape that is complementary to the shape of the inner platform that it receives, and the outer housing is of a shape that is complementary to the shape of the outer platform that it receives. The housings are dimensioned so as to receive the inner and outer platforms without damaging and without marking the sacrificial material, such that when the holder element is removed from the single-vane model, the surfaces of the inner and outer platforms do not include marks left by the holder element. There is therefore no need to perform correcting machining on the surfaces of the inner and outer platforms.

It can be understood that when the predetermined spacing between the inner platform and the outer platform is defined between a point of the inner platform, in particular a point forming part of the outer surface of the inner platform, and a point of the outer platform, in particular a point forming part of the inner surface of the outer platform at the location of the holder element, the predetermined distance may be equal to the predetermined spacing. When the predetermined spacing is defined elsewhere between the inner platform and the outer platform, the fact of holding a predetermined distance between the free end of the inner platform and the free end of the outer platform serves to hold the predetermined spacing between the inner platform and the outer platform.

According to some embodiments, the holder element includes a retention housing, the positioning step including positioning a retention element in the retention housing so that the holder element is held stationary relative to the single-vane model.

For example, the retention element may be an elastic band.

According to some embodiments, the free end is an upstream and/or downstream end.

According to some embodiments, the holder element is made by additive fabrication.

It is thus possible to give the holder element the desired shape while guaranteeing good dimensional control over the holder element, in particular over the inner and outer housings and also over the retention housing, when such a housing is present. It is also possible to adapt the holder element to shapes of different types because of the great shape-making freedom that is made available by additive fabrication. Additive fabrication also enables the holder element to be made relatively quickly at costs that are relatively low. Furthermore, when it is desired to modify the holder element, it is easy to modify the holder element by successive iterations, e.g. without any need to modify molds.

According to some embodiments, the additive fabrication is a stereo-lithographic method.

According to some embodiments, the holder element is made of a thermoplastic resin of the acrylonitrile butadiene styrene (ABS) or polyamide PA12 type.

These materials present a surface state that is smooth and they may be used to make parts that require dimensional accuracy and a degree of stiffness. The smooth surface state of the holder element makes it possible to avoid damaging the model made of sacrificial material.

According to some embodiments, the positioning step is performed after the assembly step, the holder element being positioned in a direction perpendicular to the assembly direction on a free side of the inner platform and on a free side of the outer platform of the multi-vane model so as to hold the predetermined spacing between the inner platform and the outer platform.

The holder element serves to reduce the risks of deforming a multi-vane model while multi-vane models are being handled, in particular during a step of forming a shell mold. The holder element serves to hold the predetermined spacing between the inner platform and the outer platform. It can thus be understood that the holder element is put into position before making a cluster and forming a shell mold.

It can be understood that since the holder element is put into position on a free side of the inner platform and on a free side of the outer platform of the multi-vane model, it is put into position on a free side of the inner platform and on a free side of the outer platform of the single-vane model that is located at one end of the multi-vane model in the assembly direction.

According to some embodiments, the holder element is a rod made of ceramic material.

This rod made of ceramic material is present in the shell mold and while metal is being cast into the shell mold. Thus, while metal is being cast, the volume occupied by the rod is not filled with molten metal. The ceramic material rod is separated from the multi-vane nozzle guide after the nozzle guide has cooled, while the shell mold is being separated.

According to some embodiments, the inner platform and/or the outer platform of the multi-vane model includes a reception housing for receiving the holder element.

The reception housing enables the holder element to be put into position quickly and in reproducible manner.

It can be understood that since the multi-vane model is made by assembling together a plurality of single-vane models, only the single-vane models that are situated at each of the ends of the multi-vane model in the assembly direction include reception housings.

Since the reception housings are arranged on the free sides of the platforms, they are arranged on surfaces that correspond to surface of the multi-vane model that may be machined and that affect the aerodynamic behavior of the multi-vane nozzle guide relatively little.

According to some embodiments, the positioning step includes adhesively bonding the holder element on the sacrificial material multi-vane model.

The present disclosure also provides tooling for making a sacrificial material multi-vane model for a nozzle guide, the tooling comprising:

a holder element configured to be positioned to bear against a free end of an inner platform and a free end of an outer platform of a sacrificial material single-vane model so as to hold a predetermined spacing between the inner platform and the outer platform; and/or a holder element configured to be positioned in a direction perpendicular to the assembly direction on a free side of the multi-vane model in such a manner as to hold the predetermined spacing between the inner platform and the outer platform.

According to some embodiments, the tooling may comprise a mold for making sacrificial material single-vane models that present a single vane extending between an inner platform and an outer platform.

The present disclosure also provides an assembly of a sacrificial material single-vane model for a nozzle guide together with a holder element, the sacrificial material single-vane model comprising a vane extending between an inner platform and an outer platform, the holder element being positioned so as to hold a predetermined spacing between the inner platform and the outer platform.

The present disclosure also provides an assembly of a sacrificial material multi-vane model for a nozzle guide together with a holder element, the sacrificial material multi-vane model comprising at least two sacrificial material single-vane models, each comprising a vane extending between an inner platform and an outer platform, the sacrificial material single-vane models being assembled together by adhesive bonding in an assembly direction so as to form the multi-vane model comprising at least two vanes, an inner platform, and an outer platform, the holder element being adhesively bonded in a direction perpendicular to the assembly direction on a free side of the inner platform and on a free side of the outer platform of the multi-vane model so as to hold a predetermined spacing between the inner platform and the outer platform.

BRIEF DESCRIPTION OF THE DRAWINGS

Other characteristics and advantages of the invention appear from the following description of embodiments of the invention given as non-limiting examples, and with reference to the accompanying figures, in which.

Figure 1:
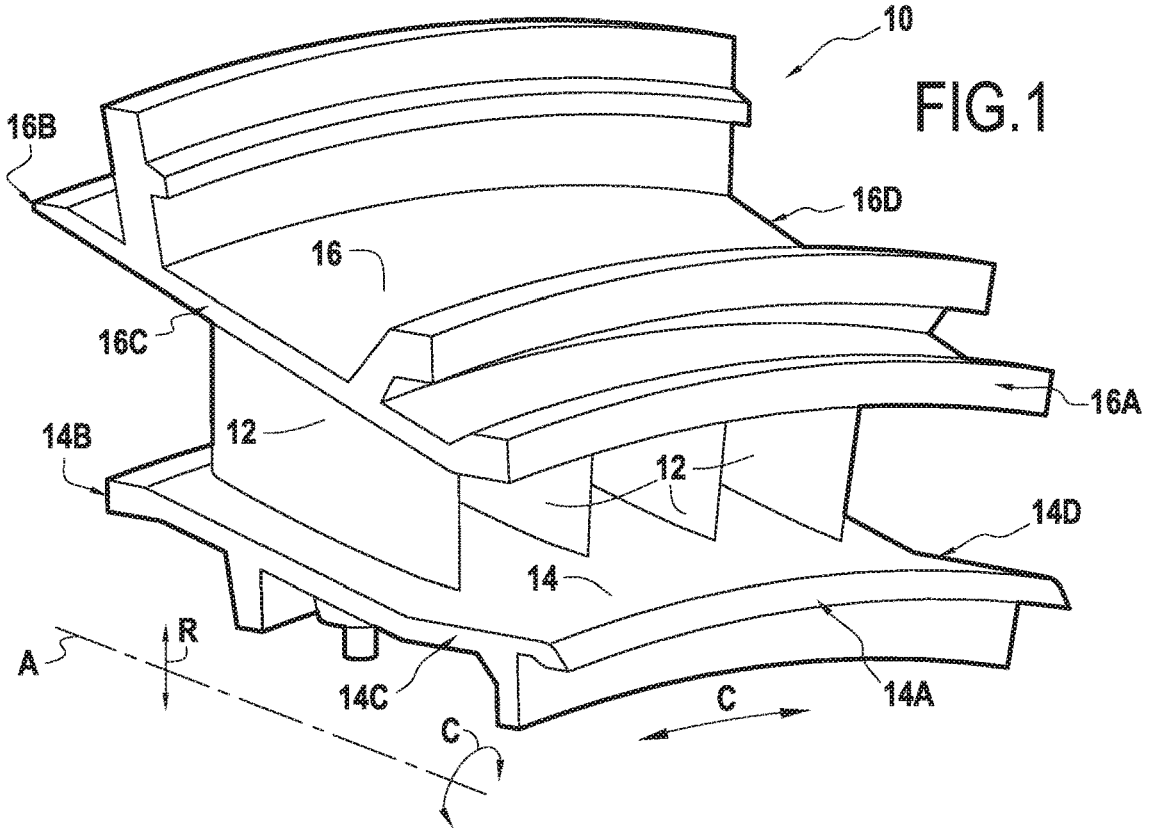
FIG. 1 is a diagrammatic perspective view of a multi-vane nozzle guide.

In the figures, elements that are in common between figures are identified by reference numerals that are identical.

DETAILED DESCRIPTION

FIG. 1 is a perspective view of a multi-vane nozzle guide 10 for a turbomachine, in particular a nozzle for a jet engine.

The multi-vane nozzle guide 10 mainly comprises a plurality of vanes 12 extending in a radial direction R between an inner platform 14 and an outer platform 16. The vanes are arranged in a circumferential direction C around a central axis A. By way of example, the central axis A is the central axis of the turbomachine once the multi-vane nozzle guide 10 is mounted in the turbomachine.

The inner and outer platforms 14 and 16 define a fluid flow passage. The inner platform 14 has an upstream free end 14A, a downstream free end 14B, and two free sides 14C and 14D. Likewise, the outer platform 16 has an upstream free end 16A, a downstream free end 16B, and a two free sides 16C and 16D.

Figure 4:
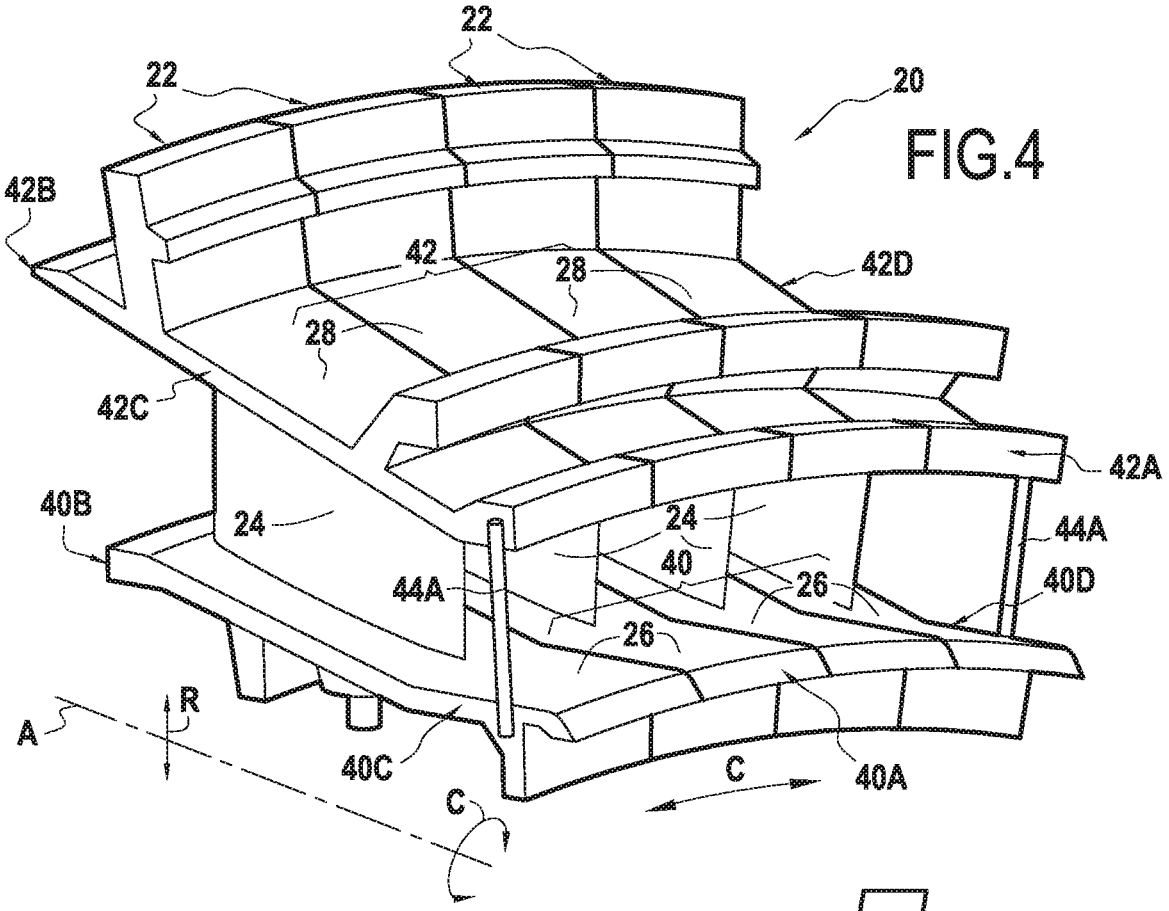
FIG. 4 is a diagrammatic perspective view of an assembly of a sacrificial material multi-vane model together with a holder element.

In order to fabricate the multi-vane nozzle guide 10 of FIG. 1, a multi-vane model 20 is made out of sacrificial material (see FIG. 4). By way of example, the sacrificial material may be wax or a resin having a melting temperature that is not very high, e.g. lower than 300° C.

The sacrificial material multi-vane model 20 is obtained by assembling together at least two sacrificial material single-vane models 22 in an assembly direction that corresponds to the circumferential direction C. In the embodiment shown in FIG. 4, the sacrificial material multi-vane model 20 comprises four single-vane models 22, each made of sacrificial material. It can be understood that the number of single-vane models 22 that are assembled together to form a multi-vane model 20 is not limited to four. It could naturally be some other number.

Figure 2:
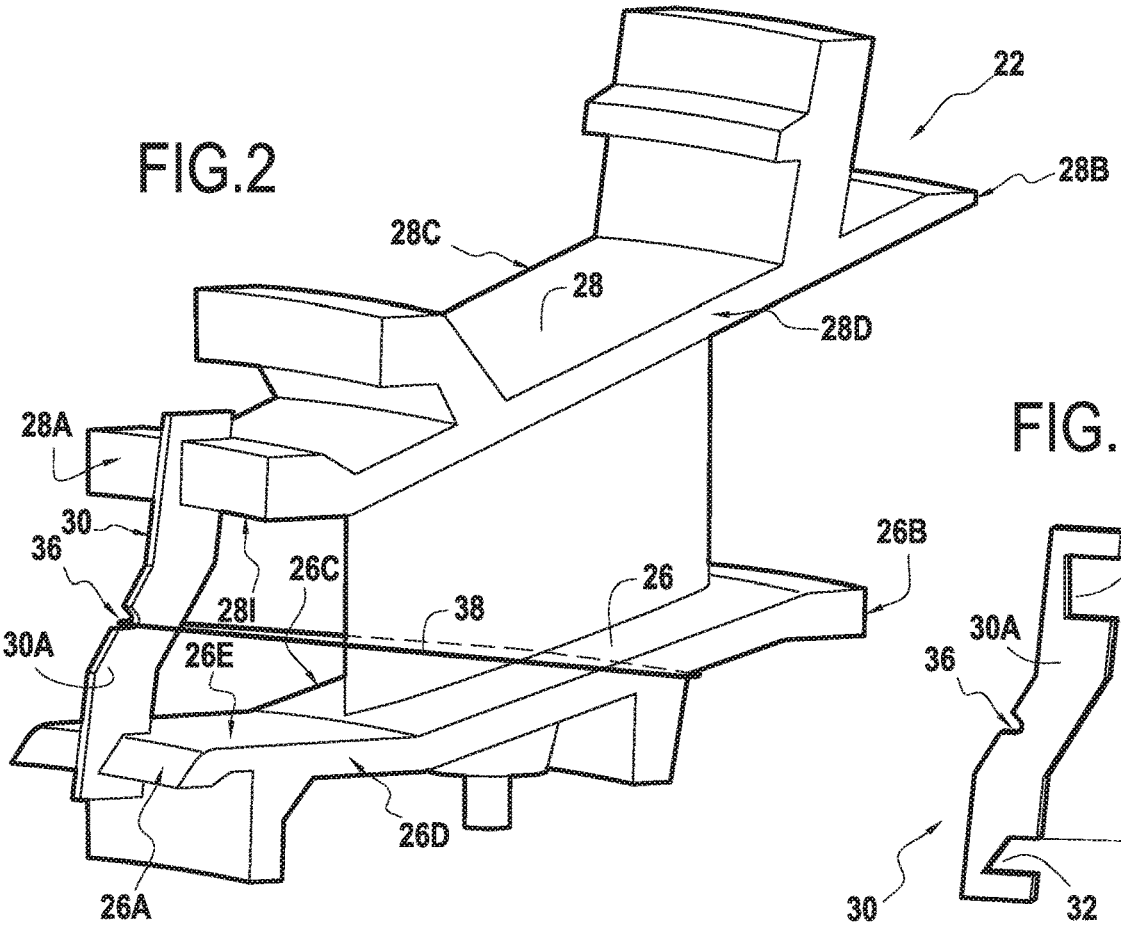
FIG. 2 is a diagrammatic perspective view of an assembly of a sacrificial material single-vane model together with a holder element.

As shown in FIG. 2, the single-vane model 22 comprises a vane 24 extending between an inner platform 26 and an outer platform 28. The inner platform 26 has an upstream free end 26A, a downstream free end 26B, and two free sides 26C and 26D, the free side 26C being on the side opposite from the free side 26D of the inner platform 26. Likewise, the outer platform 28 has an upstream free end 28A, a downstream free end 28B, and two free sides 28C and 28D, the free side 28C being on the side opposite from the free side 28D of the outer platform 28.

In FIG. 2, a holder element 30 of a first type is positioned on the single-vane model 22. In FIG. 2, the holder element 30 is a comb 30A positioned on the upstream free end 26A of the inner platform 26 and on the upstream free end 28A of the outer platform 28.

Depending on the shape of the inner and outer platforms 26 and 28, the comb 30A may be positioned on the upstream free ends 26A and 28A of the inner and outer platforms 26 and 28, and/or on the downstream free ends 26B and 28B of the inner and outer platforms 26 and 28.

Figure 3:
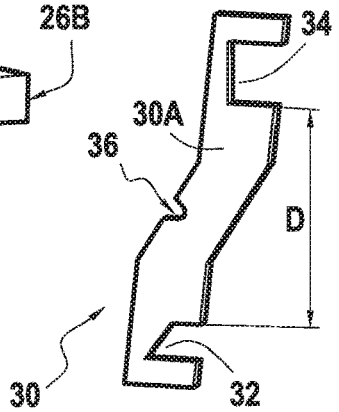
FIG. 3 is a diagrammatic view of the FIG. 2 holder element.

As shown in FIG. 3, the comb 30A has an inner housing 32 and an outer housing 34, the inner housing 32 and the outer housing 34 being spaced apart by a predetermined distance D corresponding to a desired nominal dimension between the upstream free end 26A of the inner platform 26 and an upstream free end 28A of the outer platform 28. The inner housing 32 is of shape complementary to the shape of the inner platform 26 that it receives, and the outer housing 34 is of a shape complementary to the shape of the outer platform 28 that it receives.

In the embodiment of FIG. 3, the predetermined distance D corresponds to the desired nominal dimension between an outer surface 26E of the inner platform 26 and an inner surface 28I of the outer platform 28. The outer surface 26E of the inner platform 26 and the inner surface 28I of the outer platform 28 define the fluid flow passage.

The predetermined distance D may be equal to the predetermined spacing when the predetermined spacing is defined between the outer surface 26E of the inner platform 26 and the inner surface 28I of the outer platform 28 for the position of the comb 30A. It can be understood that the predetermined spacing may be defined in some other way. Nevertheless, once the distance between the upstream free ends 26A and 28A of the inner and outer platforms 26 and 28 is held constant at the predetermined distance D, the inner and outer platforms 26 and 28 do not deform, or they deform only within acceptable limits, such that the predetermined spacing between the inner platform 26 and the outer platform 28 is held constant.

The comb 30A may be made by additive fabrication.

As shown in FIG. 2, the upstream free end 26A of the inner platform 26 is positioned in the inner housing 32, and the upstream free end 28A of the outer platform 28 is positioned in the outer housing 34. The comb 30A is arranged approximately in the middle of the inner platform 26 and of the outer platform 28, e.g. in register with the vane 12.

It can be understood that a plurality of combs 30A could be positioned on the upstream free end 26A of the inner platform 26 and on the upstream free end 28A of the outer platform 28.

In the embodiment of FIGS. 2 and 3, the comb 30A includes a retention housing 36 arranged on a side opposite from the side in which the inner and outer housings 32 and 34 are arranged. The retention housing 36 is arranged along the radial direction R between the inner housing 32 and the outer housing 34.

Furthermore, in the embodiment of FIGS. 2 and 3, a retention element 38 is positioned in the retention housing 36 so that the comb 30A is held stationary relative to the single-vane model 22. The retention element 38 is also positioned around the single-vane model 22. By way of example, the retention element 38 may be an elastic band or some other part suitable for keeping the holder element, specifically the comb 30A, in place. The retention element 38 may bear against a more massive zone of the model that does not lie in the fluid flow passage, specifically to avoid any risk of potentially deforming portions of the single-vane model 22 that have an aerodynamic role. Furthermore, the retention element 38 may easily be destroyed and/or removed from the single-vane model 22 before or after a plurality of single-vane models 22 have been assembled together.

FIG. 4 shows a sacrificial material multi-vane model 20 that is obtained by assembling together four sacrificial material single-vane models 22 along an assembly direction that corresponds to the circumferential direction C. By way of example, the single-vane models 22 may be assembled together by adhesively bonding the free sides 26C, 26D of the inner platforms 26 of each sacrificial material single-vane model 22 with one another and by adhesively bonding the free sides 28C, 28D of the outer platforms 28 of each sacrificial material single-vane model 22 with one another. The assembled-together inner platforms 26 of the single-vane models 22 form an inner platform 40 of the multi-vane model 20, and the assembled-together outer platforms 28 of the single-vane model 22 form an outer platform 42 of the multi-vane model 20.

The inner platform 40 has an upstream free end 40A, a downstream free end 40B, and two free sides 40C and 40D, the free side 40C being on the side opposite from the free side 40D of the inner platform 40. Likewise, the outer platform 42 comprises an upstream free end 42A, a downstream free end 42B, and two free sides 42C and 42D, the free side 42C being on the side opposite from the free side 42D of the outer platform 42.

In FIG. 4, a holder element 44 of a second type is positioned on the multi-vane model 20. In FIG. 4, the holder element 44 is a rod 44A positioned on the free side 40C of the inner platform 40 and the free side 42C of the outer platform 42. Likewise, in the embodiment of FIG. 4, a second rod 44A is positioned on the free side 40D of the inner platform 40 and on the free side 42D of the outer platform 42. By way of example, the rods 44A are adhesively bonded to the multi-vane model 20. By way of example, the rods 44A are made of ceramic material.

The multi-vane model 20 may have a plurality of reception housings 46 for receiving the rod 44A. It can be understood that since the multi-vane model 20 is made by assembling together a plurality of single-vane models 22, only the single-vane models 22 that are situated at each end in the assembly direction of the multi-vane model 20 need include such reception housings 46. In the embodiment of FIG. 4, the multi-vane model 20 does not have reception housings 46.

It can be understood that since the holder element 44, i.e. the rod 44A, is positioned on the free side 40D of the inner platform 40 and on the free side 42D of the outer platform 42 of the multi-vane model 20, the rod 44A is positioned on the free side 26D of the inner platform 26 and on the free side 28D of the outer platform 28 of the multi-vane model 22 arranged at one end of the multi-vane model 20 in the assembly direction.

Figure 5:
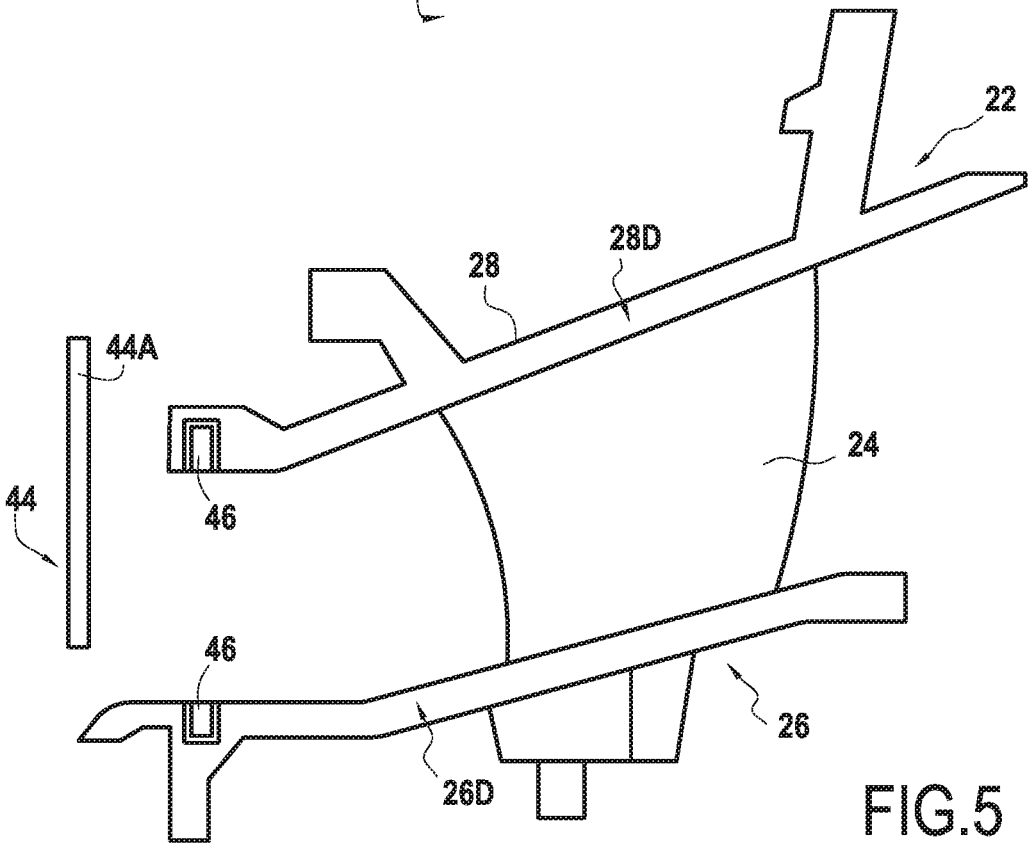
FIG. 5 is a diagrammatic side view of a sacrificial material single-vane model forming one end of the sector and having housings for receiving a holder element.
Figure 6:
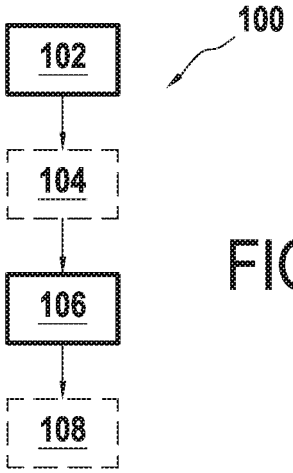
FIG. 6 is a flow chart showing the steps of a method of making a multi-vane model out of sacrificial material.
Figure 7:
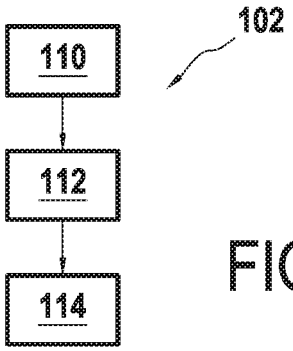
FIG. 7 is a flow chart showing step 102 of the FIG. 6 flow chart.

FIG. 5 shows a single-vane model 22 arranged at one end of the multi-vane model 20 in the assembly direction, and in particular it shows the free side 26D of the inner platform 26 and the free side 28D of the outer platform 28 of the single-vane model 22, that are respectively to form the free side 40D of the inner platform 40 and the free side 42D of the outer platform 42 of the multi-vane 20. The free side 26D of the inner platform 26 and the free side 28D of the outer platform 28 have respective reception housings 46 for receiving the rod 44A.

The embodiment of FIG. 5 has two reception housings 46. Nevertheless, there could be only one reception housing 46 arranged in the inner platform 26 or in the outer platform 28. A single reception housing 46 in a free side 26D, 28D of the single-vane model 22 corresponding to the free sides 40D, 42D of the multi-vane model 20 serves to position the rod 44A in reproducible manner.

Likewise, in the embodiment of FIG. 4, a rod 44A is arranged on the free side 40C of the inner platform 40 and on the free side 42C of the outer platform 42, and a rod 44A is arranged on the free side 40D of the inner platform 40 and on the free side 42D of the outer platform 42. In certain embodiments, there might be only one rod 44A either on one side or else on the other side of the multi-vane model 20.

There follows a description of the method 100 of making the multi-vane model 20.

The method 100 comprises a fabrication step 102 for fabricating a single-vane model 22 out of a sacrificial material, the sacrificial material single-vane model 22 comprising a vane 24 extending between an inner platform 26 and an outer platform 28.

The method 100 also comprises an assembly step 106 in which at least two sacrificial material single-vane models 22 are assembled together in the assembly direction in order to form the sacrificial material multi-vane model 20. In the embodiment of FIG. 4, four single-vane models 22 are assembled together. The number of single-vane models 22 that are assembled together to form the multi-vane model 20 is given solely by way of example. The number of single-vane models 22 could naturally be other than four.

The method 100 also has a step of positioning a holder element on at least one sacrificial material single-vane model 22 so as to maintain predetermined spacing between the inner platform 26 and the outer platform 28.

The positioning may take place between the fabrication step 102 and the assembly step 106 and/or after the assembly step 106.

The positioning step 104 takes place between the fabrication step 102 and the assembly step 106, while the positioning step 108 takes place after the assembly step 106. It can be understood that the method 100 may include one positioning step 104 between the fabrication step 102 and the assembly step 106, and another positioning step 108 after the assembly step 106. The method 100 could also have only one of the two positioning steps, either the positioning step 104 between the fabrication step 102 and the assembly step 106, or else the positioning step 108 after the assembly step 106.

In the positioning step 104 between the fabrication step 102 and the assembly step 106, a holder element is put into position on a single-vane model 22, and in particular the comb 30A is put into position on the single-vane model 22 with the upstream free end 26A of the inner platform 26 being positioned in the inner housing 32 and the upstream free end 28A of the outer platform 28 being positioned in the outer housing 34. The comb 30A is arranged approximately in the middle of the inner platform 26 and of the outer platform 28.

The positioning step 104 between the fabrication step 102 and the assembly step 106 can also include positioning the retention element 38, which is positioned in the retention housing 36 so that the comb 30A is held stationary relative to the single-vane model 22.

The retention element 38 is also positioned around the single-vane model 22. By way of example, the retention element 28 may be an elastic band or some other part serving to keep the holder element, specifically the comb 30A, in place.

Advantageously, during the positioning step 104 between the fabrication step 102 and the assembly step 106, a comb 30A is positioned on each single-vane model 22.

After the positioning step 104 between the fabrication step 102 and the assembly step 106, in the embodiment of FIG. 2, in order to assemble together two single-vane models 22, the retention element 38 is removed. The comb 30A may be removed before or after the assembly step 106 of assembling the single-vane models 22 together. Likewise, if the retention element 38 does not impede assembly of the single-vane models 22, then the retention element 38 may be removed before or after the assembly step 106. The comb 30A and the retention element 38 are removed before the step of fabricating the shell mold, in particular before dipping the multi-vane model 20 in a slurry.

In the positioning step 108 after the assembly step 106, a holder element is positioned on the multi-vane model 20, in particular, a rod 44A is positioned on the free side 40A of the inner platform 40 and on the free side 42C of the outer platform 42, and a rod 44A is positioned on the free side 40D of the inner platform 40 and on the free side 42D of the outer platform 42.

Naturally, and as emphasized above, the positioning step 108 after the assembly step 106 may include positioning a rod 44A on the free side 40C of the inner platform 40 and on the free side 42C of the outer platform 42, or positioning a rod 44A on the free side 40D of the inner platform 40 and on the free side 42D of the outer platform 42.

Putting the rod 44A in position may comprise positioning the rod 44A in one or two reception housings 46 for receiving the rod 44A.

Furthermore, during the step 102 of fabricating the single-vane model 22, the single-vane model 22 may be made by additive fabrication. When the multi-vane model 20 includes a reception housing 46, the reception housing 46 may likewise be obtained by additive fabrication.

The single-vane model 22 may also be obtained by molding the sacrificial material in a mold.

When the single-vane model 22 is obtained by molding the sacrificial material in a mold, the step 102 of fabricating the single-vane model 22 may include a step 110 of injecting the sacrificial material into a mold in order to form the single-vane model 22 out of sacrificial material, a step 112 of unmolding the sacrificial material single-vane model 22, and a step 114 of shaping the sacrificial material single-vane model 22 after it has been unmolded.

During the shaping step 114, the single-vane model 22 as extracted from the mold is placed in shaping tooling that serves to shape the single-vane model 22 while the sacrificial material is cooling down to a temperature close to ambient temperature.

When the single-vane models are obtained by molding the sacrificial material in a mold and when the single-vane models 22 include reception housings 46, the reception housings 46 may be obtained after the shaping step 114 by using additive fabrication to add material to the single-vane model 22. Thus, it is possible to have a single type of mold for all of the single-vane models 22. It can be understood that it is possible to have a plurality of molds of the same type in order to be able to fabricate a plurality of single-vane models 22 in a single step.

It is also possible to have a first type of mold for the single-vane model 22 that is arranged at the first end of the multi-vane model 20 in the assembly direction, a second type of mold for the single-vane model 22 that is arranged at a second of the multi-vane model 20 in the assembly direction, and when the multi-vane model 20 has more than two single-vane models 22, a third type of mold for the single-vane model(s) 22 that is/are arranged between the single-vane models 22 that are arranged at the first and second ends of the multi-vane model 20.

In order to form a casting mold, a plurality of multi-vane models 20 are assembled together in a cluster and the assembly is dipped in a slurry in order to form the shell mold. During this dipping step, the presence of the rods 44A serves to avoid deforming the inner and outer platforms 40 and 42 of the multi-vane model 20. Once the slurry has solidified, the sacrificial material is melted in order to form the cavities in which the multi-vane vane sectors are cast and the rods 44A remain in the shell mold.

After solidifying and being unmolded, the multi-vane sectors may be machined, where necessary, e.g. in order to move the marks of the reception housings 46 that are left on the platform.

Although the present disclosure is described with reference to a specific embodiment, it is clear that various modifications and changes may be undertaken to those examples without going beyond the general ambit of the invention as defined by the claims. In particular, individual characteristics of the various embodiments mentioned may be combined in additional embodiments. Consequently, the description and the drawings should be considered in a sense that is illustrative rather than restrictive.

The invention claimed is:

1. A method of making a sacrificial material multi-vane model for a nozzle guide, the method comprising the following steps:

fabricating a sacrificial material single-vane model, the sacrificial material single-vane model comprising a vane extending between an inner platform and an outer platform;

assembling at least two sacrificial material single-vane models in an assembly direction in order to form the sacrificial material multi-vane model that has at least two vanes, an inner platform, and an outer platform; and between the fabrication step for fabricating and the assembly step for assembling together and/or after the assembly step;

a positioning step for positioning a holder element on at least one sacrificial material single-vane model so as to hold predetermined spacing between the inner platform and the outer platform.

2. A method according to claim 1, wherein the positioning step is performed between the fabrication step and the assembly step, the holder element being positioned on the single-vane model.

3. A method according to claim 2, wherein the holder element includes an inner housing and an outer housing, the inner housing and the outer housing being spaced apart by a predetermined distance corresponding to a desired nominal dimension between a free end of the inner platform and a free end of the outer platform, the positioning step comprising positioning the free end of the inner platform in the inner housing and positioning the free end of the outer platform in the outer housing.

4. A method according to claim 2, wherein the holder element includes a retention housing, the positioning step including positioning a retention element in the retention housing so that the holder element is held stationary relative to the single-vane model.

5. A method according to claim 1, wherein the positioning step is performed after the assembly step, the holder element being positioned in a direction perpendicular to the assembly direction on a free side of the inner platform and on a free side of the outer platform of the multi-vane model so as to hold the predetermined spacing between the inner platform and the outer platform.

6. A method according to claim 5, wherein the holder element is a rod made of ceramic material.

7. A method according to claim 5, wherein the inner platform and/or the outer platform of the multi-vane model includes a reception housing for receiving the holder element.

8. A method according to claim 5, wherein the positioning step includes adhesively bonding the holder element on the sacrificial material multi-vane model.

* * * * *